US006976323B1

(12) United States Patent
Halliday

(10) Patent No.: US 6,976,323 B1
(45) Date of Patent: Dec. 20, 2005

(54) FOOTWEAR SYSTEM WITH READILY INTERCHANGEABLE COMPONENTS

(76) Inventor: David Charles Halliday, 255 Huguenot St., Apt. 1809, New Rochelle, NY (US) 10801

( * ) Notice: Subject to any disclaimer, the term of this patent is extended or adjusted under 35 U.S.C. 154(b) by 0 days.

(21) Appl. No.: 10/862,184

(22) Filed: Jun. 7, 2004

(51) Int. Cl.[7] ..... A43B 3/24
(52) U.S. Cl. ..... 36/101; 36/15; 36/101
(58) Field of Search ..... 36/15, 100, 101

(56) References Cited

U.S. PATENT DOCUMENTS

| | | | | |
|---|---|---|---|---|
| 3,526,976 | A * | 9/1970 | Jacobs | 36/100 |
| 5,533,280 | A * | 7/1996 | Halliday | 36/101 |
| 2003/0200676 | A1 * | 10/2003 | Gross | 36/15 |
| 2004/0194351 | A1 * | 10/2004 | Gallegos | 36/140 |

* cited by examiner

*Primary Examiner*—Ted Kavanaugh

(57) ABSTRACT

A footwear with interchangeable components that includes, an interchangeable mid-sole foot bed w/upper, an interchangeable mid-sole chassis, an interchangeable mid-sole foot bed interlocker, and an interchangeable lug-treading. The interchangeable mid-sole foot bed w/upper is removably mounted to the interchangeable mid-sole foot chassis and interlocked with an interchangeable mid-sole interlocker so that interchangeable mid-sole foot bed w/upper can be readily changed by user according to user preference. The interchangeable mid-sole chassis is removably mounted to the interchangeable mid-sole foot bed w/upper and interlocked by the interchangeable mid-sole foot bed interlocker and interchangeable lug-treading so that the interchangeable mid-sole chassis can be readily changed by user according to user preference. The inter-changeable mid-sole foot bed interlocker is removably mounted to both interchangeable mid-sole foot bed w/upper and interchangeable mid-sole chassis so that the interchangeable mid-sole foot bed interlocker can be readily changed by user accordingly to user preference. And, the interchangeable lug-treading is removably mounted to the an interchangeable mid-chassis so that the interchangeable lug-treading can be readily changed by user according to user preference.

1 Claim, 4 Drawing Sheets

FOOTWEAR SYSTEM WITH READILY INTERCHANGEABLE COMPONENTS

BACKGROUND OF THE INVENTION

1. Field of the Invention

The present invention relates to footwear. More particularly, the present invention relates to footwear having interchangeable components such an interchangeable mid-sole foot bed w/upper, an interchangeable mid-sole chassis, an interchangeable mid-sole interlocker, and an mid-sole interchangeable lug-treading system.

2. Description of the Prior Art

In the field of footwear, wearers differ in individual tastes and physical requirements. Therefore there exists a need for people to customize their own footwear according to their individual needs. For example, individual persons prefer a wide range of styles and colors of footwear. Also, individual persons have unique physical characteristics and participate in different types of activities, which could cause footwear to wear in different places.

Due to these factors, many different styles of footwear have been developed based on the persons individual tastes and needs. These different styles still may not fit every person's needs and tastes. Therefore, it is desirable for a person to select a style of footwear he/she prefers and then customize the footwear to his/her characteristics and activities.

Numerous innovations for footwear having interchangeable components have been provided in the prior art that are described as follows. Even though these innovations may be suitable for the specific individual purposes to which they address, they differ from the present invention as hereinafter contrasted.

The U.S. Pat. No. 4,814,661 to Razlaff et al. discloses a shoe which may be used to measure and analyze the forces exerted by a wearer during normal activities. This patent differs from the present invention in that it does not have component parts which are interchangeable to suit the individual needs of the wearer.

U.S. Pat. No. 6,601,042 to Lyden discloses customized footwear with a spring element this patent differs from present invention because the footwear is tailored to individual specifications.

U.S. Pat. No. 3,646,497 to Gillikin et al. and U.S. Pat. No. 4,219,946 to Baum et at. both disclose a shoe that has an interchangeable heel. This patent differs from the present invention because the heels are only interchangeable.

U.S. Pat. No. 3,983,642 to Liao et at. discloses a shoe with interchangeable uppers. This patent differs from the present invention because the uppers are only interchangeable.

U.S. Pat. No. 5,317,822 to Johnson et al. discloses an athletic shoe with an interchangeable sole. This patent differs from the present invention because the soles are only interchangeable and attached to the athletic shoe by VELCRO™ and interlocking devices.

U.S. Pat. No. 5,282,288 to Henson et. al. discloses an athletic shoe with permanently attached interchangeable sole inserts. This patent differs from the present invention because only the sole inserts are interchangeable and they are permanently attached.

U.S. Pat. No. 6,481,121 B1 to Tucker et. al. discloses an enhancing performance shoe with interchangeable accessories. This patent differs from the present invention because only the sole are interchangeable.

U.S. Pat. No. 6,389,712 B1 to Schelling et. al. discloses an shoe with interchangeable sole. This patent differs from the present invention because only the sole are interchangeable.

U.S. Pat. No. 6,449,878 B1 to Lyden et. al. discloses an spring element with replaceable components. This patent differs from the present invention because interchangeable parts doesn't interlock with-in itself.

U.S. Pat. No. 5,799,417 & 6,023,859 to Burke et. al. discloses an enhancing performance shoe with interchangeable heel insert accessories. This patent differs from the present invention because only the sole are interchangeable.

U.S. Pat. No. des. 414,020 to Manradgh et. al. discloses an shoe with replaceable sole insert accessories. This patent differs from the present invention because only the sole are replaceable.

U.S. Pat. No. 5,533,280 to Halliday et. al. discloses an shoe with interchangeable components. This patent differs from the present invention because the interchangeable components are interlocked from the shoe interior.

Numerous innovations for footwear with interchangeable components have been provided in the prior art that are adapted to be used. Even though these innovations may be suitable for the specific individual purposes to which they address, they would not be suitable for the purposes of the present invention as heretofore described.

SUMMARY OF THE INVENTION

The present invention describes footwear with interchangeable components enabling the differently styled components to be assembled to suit the tastes of the individual user.

Each piece of footwear is constructed from components that can be assembled from a list of alternative designs. Dress shoes, running shoes and casual designs can be created from these alternative designs. The basic components are: an interchangeable mid-sole foot bed w/upper, an interchangeable mid-sole chassis, an interchangeable mid-sole interlocker, and an interchangeable lug-treading are assembled in a manner that does not require adhesive. The interchangeable mid-sole foot bed w/upper including cushioning insole and an interchangeable mid-sole chassis selected to suit the application are held in place by the interchangeable mid-sole interlocker. And the lug-treading is held by the chassis. The result of the invention is footwear that is custom made and easily repairable.

A piece of footwear is designed by a user selecting an interchangeable mid-sole foot bed w/upper, an interchangeable mid-sole chassis, an interchangeable mid-sole interlocker, and an interchangeable lug-treading from various options. The interchangeable mid-sole foot bed w/upper, an interchangeable mid-sole chassis, an interchangeable mid-sole interlocker, and an interchangeable lug-treading are then automatically selected based on the user's choice. The components are then assembled by fitting them together. The resulting shoe should prove lighter in weight, more durable and easier to repair.

This invention enables users to custom design their own footwear according to their individual needs. This concept provides for flexibility in the styling by working around a basic architecture. Anyone who desires a quality shoe that does not currently exist should find this invention an ideal alternative.

Accordingly, it is an object of the present invention to provide footwear that would allow a user to custom design their own footwear according to their individual needs.

More particularly, it is an object of the present invention to provide footwear with an interchangeable mid-sole foot bed w/upper, an interchangeable mid-sole chassis, that are held together by an interchangeable mid-sole interlocking system and an interchangeable lug-treading interlocks to chassis base.

In keeping with these objects, and with others which will become apparent hereinafter, one feature of the present invention resides, briefly stated, is that various styles of footwear can be achieved.

When the footwear with interchangeable components is designed in accordance with the present invention, the entire footwear can be assembled or dissembled in minutes.

In accordance with another feature of the present invention, no gluing is required for assembly.

Another feature of the present invention is that it is lighter than some existing footwear.

Yet another feature of the present invention is that the mid-sole interlocker of footwear with interchangeable components can be designed to vary in flexible footwear with interchangeable components and cushioning composition.

Still another feature of the present invention is that it provides space to absorb impact plus response to foot movements simultaneously.

Yet still another feature of the present invention is that the individual components move independently in response to foot movement providing maximum comfort.

Still yet another feature of the present invention is that the interchangeable components have an interlocking system enabling a person to custom design their own footwear according to their individual needs.

Another feature of the present invention is that it has interchangeable and replaceable parts, thus, reducing the overall cost of having numerous shoes for different purposes such as specially designed interchangeable lug-treading to play tennis and other interchangeable mid-sole lug-treading to play golf. The present invention can utilize the same upper pans of the shoe while interchanging the interchangeable lug-treading portions. Similarly, the upper portions of the shoe can be interchanged to vary color.

Yet another feature of the present invention is that the components fit together without the use of glue during assembly. Yet non-permanent adhesive may be utilized.

Still another feature of the present invention is that the shoes may have various styles, standards, and multiple interlocking parts.

Yet still another feature of the present invention is that the shoe is lighter than existing footwear and utilizes different engineered structuring to allow footwear parts to move independently in response to foot movement within, due to the non-permanent adhesive construction. Therefore, a single unit will yield maximum comfort.

Another feature of the present invention is that the interlocking component system allows space for impact and response to foot movements simultaneously.

Another feature of the present invention is that composite materials may be utilized individually and in combination during integration and manufacturing of the individual component pans.

Yet another feature of the present invention is that the entire footwear can be assembled, reassembled and disassembled in minutes which facilitates replacement of individual pans and requiring less space in luggage while traveling.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF LIST OF REFERENCE NUMERALS UTILIZED IN THE DRAWING

Figure 1A:
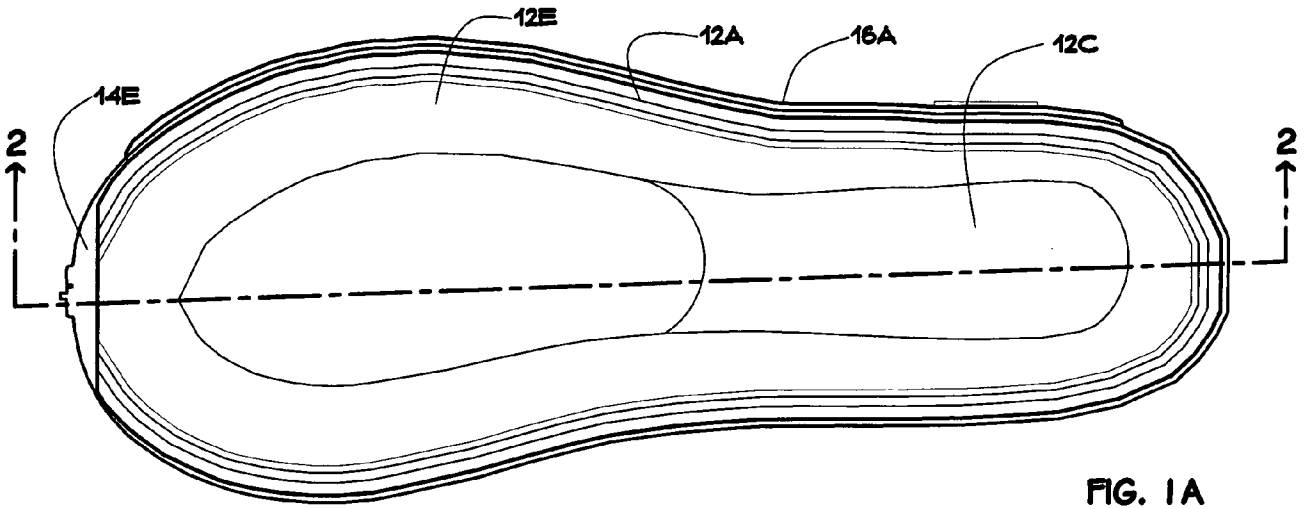
FIG. 1A is a top view of the footwear with interchangeable components exhibiting the an interchangeable mid-sole foot bed w/upper member connected to the an interchangeable mid-sole chassis containing the mid-sole interlocker and cushion therein.

10—"FootWorks" T. I.—footwear with interchangeable components 10
12—mid-sole foot bed 12
12A—mid-sole foot bed side walls 12A
12B—mid-sole foot bed supporter groves; front, middle, & rear 12B
12C—mid-sole foot bed supporter ridge 12C
12D—mid-sole foot bed supporter ridge rest 12D
12E—mid-sole foot bed upper member 12E
12F—mid-sole foot bed heel cushion 12F
14—mid-sole chassis 14
14A—mid-sole chassis upper supporter ridge 14A
14B—mid-sole chassis supporter groves; front, middle, & rear 14B
14C—mid-sole chassis lower supporter 14C
14D—mid-sole chassis interlocker groove 14D
14E—mid-sole chassis toe supporter rest 14E
14F—mid-sole chassis heel supporter rest 14F
14G—mid-sole chassis heel interlocker groove 14G
14H—mid-sole chassis supporter ridge rest 14H
16—mid-sole interlocker 16
16A—mid-sole interlocker side wall 16A
16B—mid-sole interlocker cushioning sleeves; front, middle & rear 16B

16C—mid-sole interlocker supporter ridges; front, middle & rear 16C
18—mid-sole lug-treading system 18
18A—mid-sole lug-treading connectors 18A
18B —mid-sole lug-treading voids 18B
18C—mid-sole lug-treading lateral supports 18C
18D—mid-sole lug-treading heel supporter 18D

DETAILED DESCRIPTION OF THE PREFERRED EMBODIMENT

Firstly, referring to FIG. 1A which is a top view of the footwear with interchangeable components 10 exhibiting an upper member 12E connects to the mid-sole foot bed in side walls 12A of mid-sole foot bed 12. The upper member 12E is firmly attached by adhesive and/or stitching sewing method within a mid-sole along the mid-sole foot bed perimeter walls 12A to houses the mid-sole foot bed 12 is removably mounted to a mid-sole chassis 14 and is secured with the mid-sole interlocker 16.

Figure 1B:
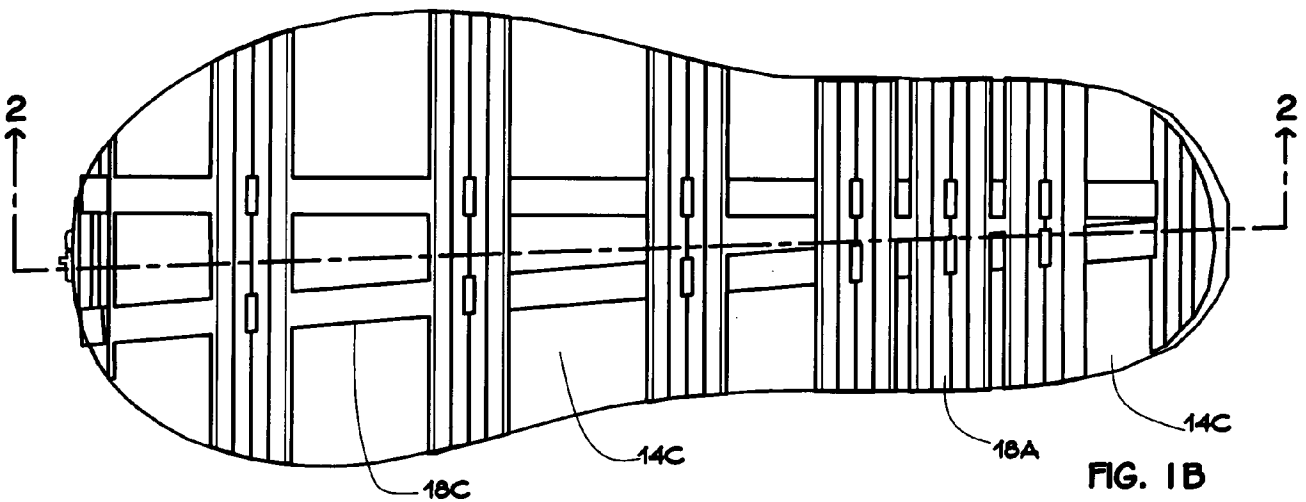
FIG. 1B is a bottom view of the footwear with interchangeable components exhibiting the mid-sole chassis interlocking with the lug-treads system.

Now referring to FIG. 1B which is a bottom view of the footwear with interchangeable components 10 exhibiting a mid-sole chassis 14 lower member and the mid-sole lug tread system 18 connected to a mid-sole chassis bottom 14D which is removably inserted securely into a chassis supporter base interlocker groove 14C. The interchangeable mid-sole chassis 14 may be constructed from one composite component or from separate composite materials of varying densities. The function of the removability of the mid-sole chassis 14 and lower member mid-sole lug treading system 18 is to allow the user to vary the mid-sole lug-tread system design, depth, density, gripability to accommodate the user in different activities such as sports and varying environmental conditions.

Figure 2:
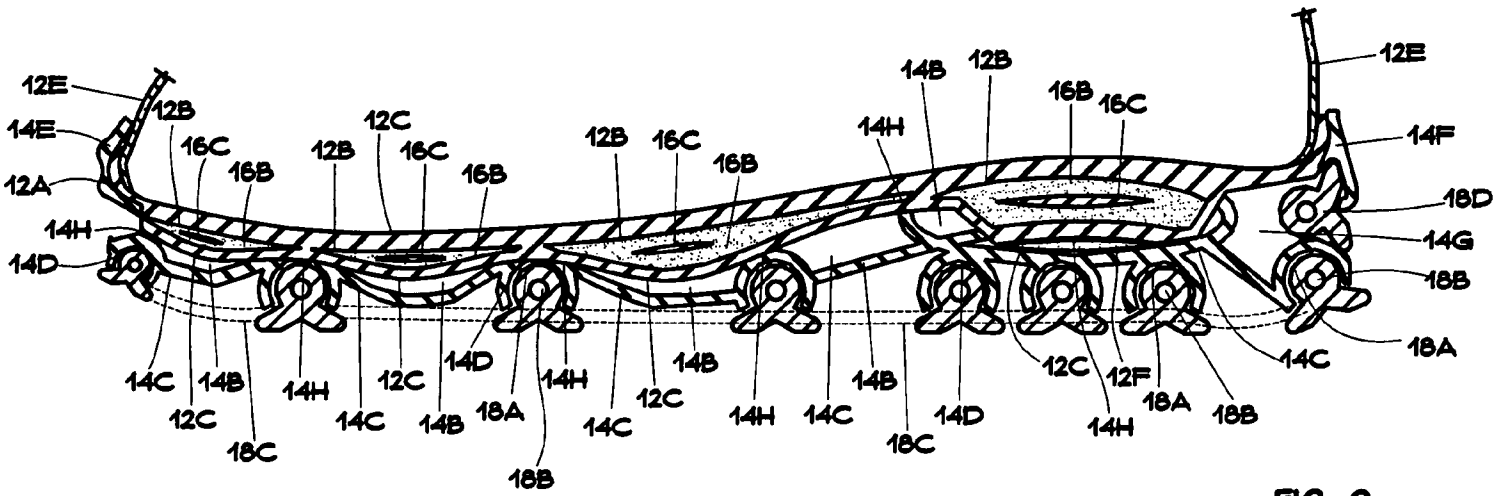
FIG. 2 is a longitudinal cross sectional view taken along line 2—2 in FIGS. 1A and 1B of footwear with interchangeable components exhibiting the upper member attached to the interchangeable mid-sole chassis and interlocking components contained therein.

Referring to FIG. 2 which is a lateral cross sectional view taken along line 2—2 of the footwear with interchangeable components 10 exhibiting the upper member 12E attached to the interchangeable and interlocking components contained therein exhibiting the following features: mid-sole foot bed side walls 12A; mid-sole foot bed supporter groves; front, middle, & rear 12B; mid-sole foot bed supporter ridge 12C; mid-sole foot bed supporter ridge rest 12D; mid-sole foot bed upper member 12E; mid-sole foot bed heel cushion 12F; mid-sole chassis 14; mid-sole chassis upper supporter ridge 14A; mid-sole chassis supporter groves; front, middle, & rear 14B; mid-sole chassis lower supporter 14C; mid-sole chassis interlocker groove 14D; mid-sole chassis toe supporter rest 14E; mid-sole chassis heel supporter rest 14F; mid-sole chassis heel interlocker groove 14G; mid-sole chassis supporter ridge rest 14H; mid-sole interlocker 16; mid-sole interlocker side wall 16A; mid-sole interlocker cushioning sleeves; front, middle & rear 16B; mid-sole interlocker supporter ridges; front, middle & rear 16C; mid-sole lug-treading system 18; mid-sole lug-treading connectors 18A; mid-sole lug-treading voids 18B; mid-sole lug-treading lateral supports 18C; and the mid-sole lug-treading heel supporter 18D. The mid-sole lug-treading system 18 functions as the outer tread which is in contact with the surface.

The interchangeable mid-sole lug-treading system member 18 includes mid-sole lug-treading connectors 18A and mid-sole lug-treading voids 18B mid-sole lug-treading lateral supports 18C, and the mid-sole lug-treading heel supporter 18D may be varying designs depending on the desired grip and surface for which it will be used. The mid-sole lug-treading system member 18 includes mid-sole lug-treading connectors 18A—which interlocks securely with 14D, mid-sole lug-treading voids 18B, mid-sole lug-treading lateral supports 18C—which stretches along the mid-sole chassis member bottom 14, and the mid-sole lug-treading heel supporter 18D—which is interlocked with the mid-sole chassis heel supporter rest 14F, mid-sole lug-treading system maybe be one composite or two separate components, of the same or differing material, firmly attached. The interchangeability allows the user to get different grip and support under varying conditions and activities.

The mid-sole chassis member 14 includes the mid-sole chassis upper supporter ridge 14A allows mid-sole foot bed supporter ridge rest 12D to mountable; mid-sole chassis supporter groves; front, middle, & rear 14B allows mid-sole interlocker 16 includes mid-sole interlocker cushioning sleeves; front, middle & rear 16B, mid-sole interlocker supporter ridges, front, middle & rear 16C to be interlocked.

The mid-sole foot bed 12 is removably mounted to a mid-sole chassis 14 and is securely interlocked with mid-sole interlocker 16 laterally through the mid-sole foot bed supporter groves; front, middle, & rear 12B and the mid-sole chassis supporter groves; front, middle, & rear 14B to be interlocked with the mid-sole interlocker 16, mid-sole chassis lower supporter 14C allows the mid-sole foot bed supporter ridge 12C to rest mountable, mid-sole chassis interlocker groove 14D allows the interchangeable mid-sole lug-treading system member 18 to be interlocked, mid-sole chassis toe supporter rest 14E, mid-sole chassis heel supporter rest 14F; mid-sole chassis heel interlocker groove 14G allows mid-sole lug-treading heel supporter 18D to be interlocked, mid-sole chassis supporter ridge rest 14H of the mid-sole chassis 14 maybe be one composite or two separate components, of the same or differing material, firmly attached. The interchangeability allows the user to get different style and support under varying conditions and activities.

The mid-sole foot bed 12 includes a mid-sole foot bed side walls 12A allows the mid-sole foot bed upper member 12E to securely attached, mid-sole foot bed supporter groves, front, middle, & rear 12B—which is mounted on to and partially into the mid-sole chassis 14 and the mid-sole chassis supporter groves; front, middle, & rear 14B both are aligned to receive mid-sole interlocker 16, the mid-sole foot bed supporter ridge 12C mounts on the mid-sole chassis supporter ridge rest 14H, the mid-sole foot bed supporter ridge rest 12D mounts to mid-sole chassis toe supporter rest 14E, mid-sole chassis heed supporter rest 14F and the mid-sole chassis top perimeter mid-sole foot bed heel cushion 12F rests in the mid-sole chassis heel cavity will allow for various support, padding, and absorption.

Figure 3:
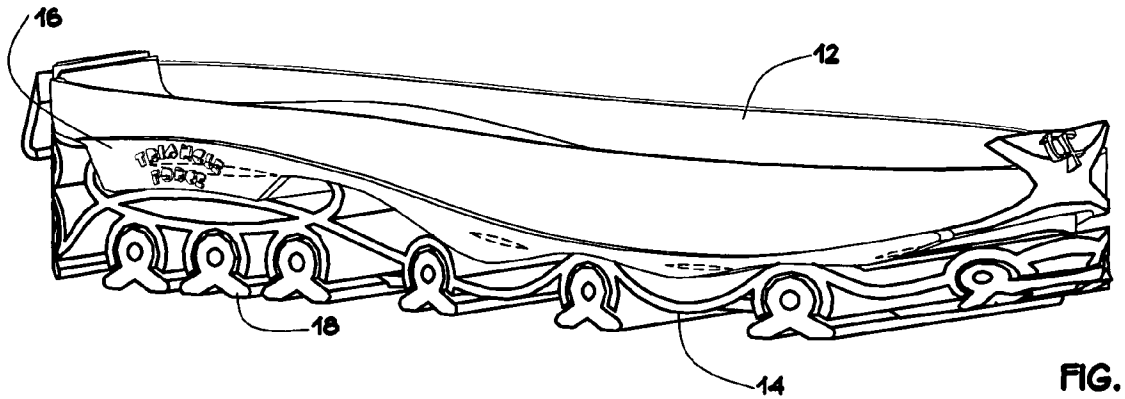
FIG. 3 is an perspective view of the footwear with interchangeable components exhibiting footwear with interchangeable components exhibiting how the members are mounted and attached to the interchangeable and interlocking components contained therein.
Figure 3A:
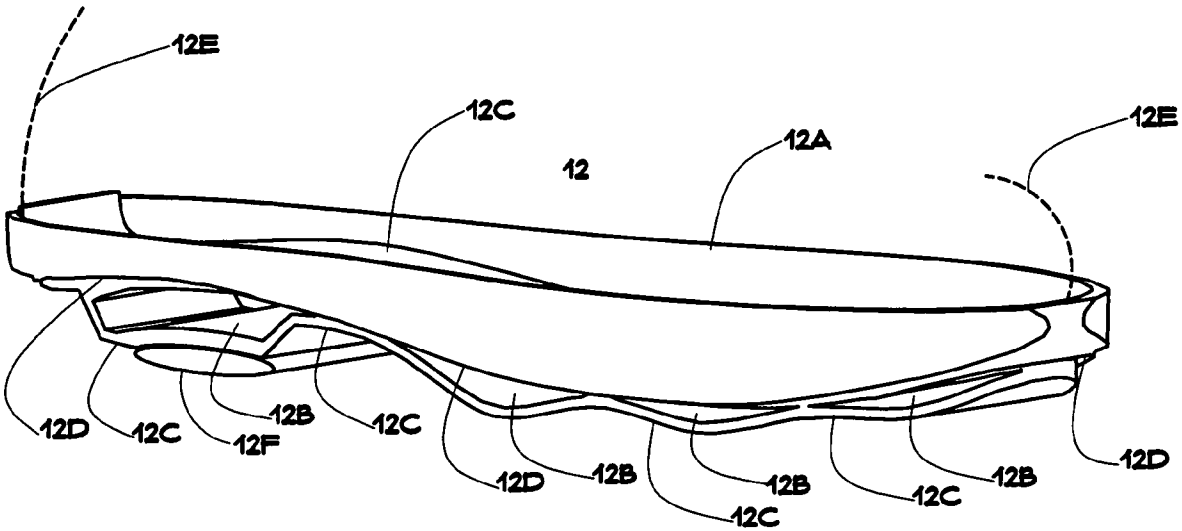
FIG. 3A is an perspective view of the footwear interchangeable component exhibiting the mid-sole foot bed with upper to be mounted to FIG. 3B.
Figure 3B:
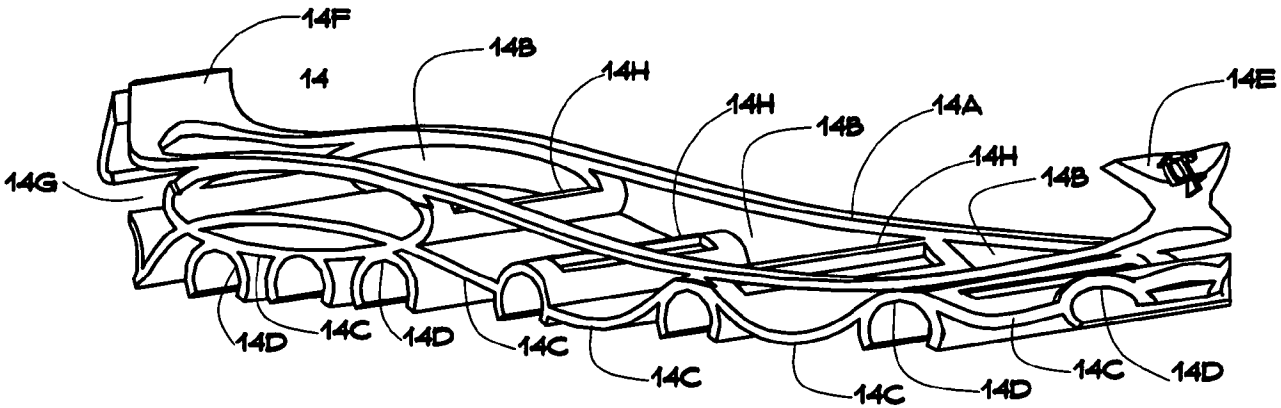
FIG. 3B is an perspective view of the footwear interchangeable component exhibiting the mid-sole chassis to be mounted with FIGS. 3A, 3C and 3D.
Figure 3C:
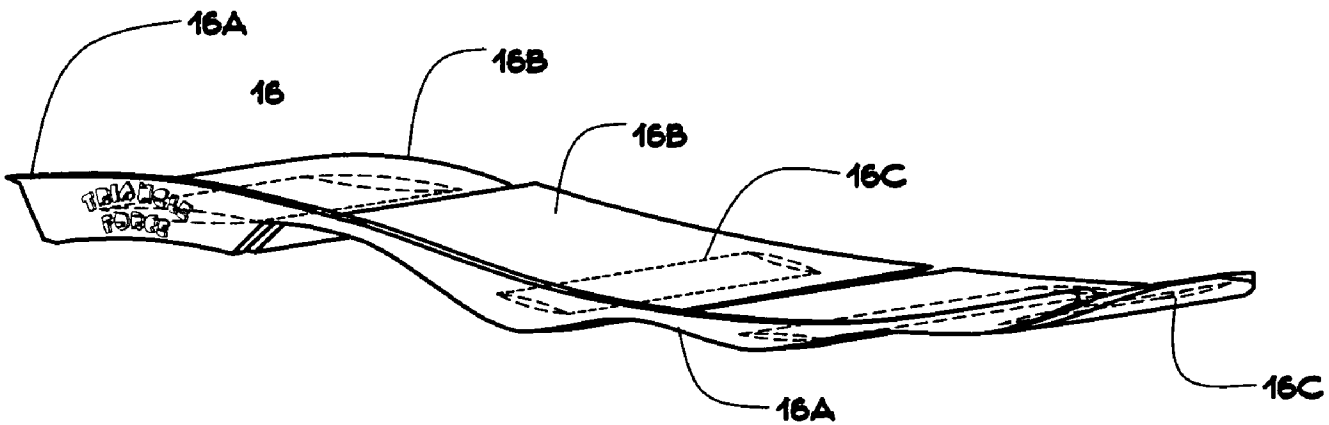
FIG. 3C is an perspective view of the footwear interchangeable components exhibiting the mid-sole interlocker w/cushioning to be interlocked with both FIGS. 3A and 3B.
Figure 3D:
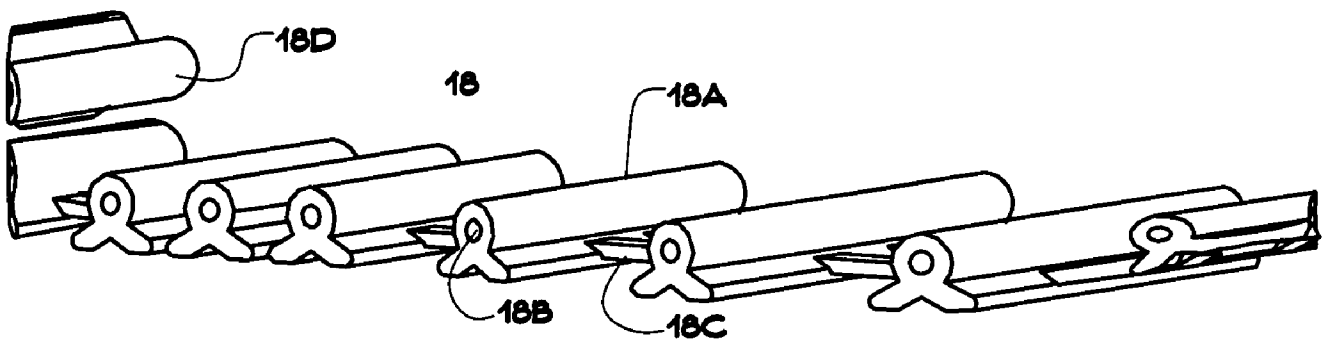
FIG. 3D is an perspective view of the footwear interchangeable components exhibiting the mid-sole lug treading system to be interlocked FIG. 3B w/the heel component which interlocks to both 3A and 3B.

FIG. 3 is an perspective view of the footwear complete assembled interchangeable components with FIG. 3A interchangeable mid-sole foot bed 12 is removably mountable to FIG. 3B interchangeable mid-sole chassis 14 Interlocked with FIG. 3C mid-sole interlocker 16 and 16A functions to provide a cushioning means for the user. The cushion 16A can be removed and substituted with another cushion 16A with different characteristics such as firmness, softness, thickening and/or absorb ability. FIG. 3D the mid-sole lug-treading system 18 includes 18B the lug-treading connector and stabilizer, 18A a void in the lug-treads for additional shock absorption.

What is claimed is:

1. A footwear system comprising readily interchangeable components, the components comprising:

a) an interchangeable midsole footbed having a footwear upper attached thereto, a lower side of the midsole footbed having downwardly extending support grooves along the length of the footbed;

b) an interchangeable midsole chassis having on a topside interlocking support grooves on opposing lateral sides and on the lower side laterally extending interlocking grooves;

c) an interchangeable midsole interlocker; and d) an interchangeable midsole lug treading;

wherein the components can be readily changed by a user, the midsole footbed is removably mounted to a top side of the midsole chassis and is securely interlocked with the midsole interlocker laterally through the midsole footbed support grooves and the midsole chassis support grooves and the midsole lug treading is removably mounted to the laterally extending grooves on the lower side of the midsole chassis.

* * * * *